United States Patent [19]

Badria

[11] Patent Number: 4,671,462

[45] Date of Patent: Jun. 9, 1987

[54] SPRINKLERS

[75] Inventor: Joseph L. Badria, Transvaal, South Africa

[73] Assignee: Gerardus Johannes Kraaij, Transvaal, South Africa; a part interest

[21] Appl. No.: 778,267

[22] Filed: Sep. 20, 1985

[30] Foreign Application Priority Data

Sep. 20, 1984 [ZA] South Africa ..... 84/7397
Sep. 16, 1985 [ZA] South Africa ..... 85/7080

[51] Int. Cl.[4] ..... B05B 3/06; B05B 3/16

[52] U.S. Cl. ..... 239/227; 239/236; 239/243; 239/252; 239/255; 239/259; 239/DIG. 1; 74/800

[58] Field of Search ..... 239/251, 252, 253, 255, 239/256, 258, 98, 97, 227, 236, 243, 259, DIG. 1; 74/800

[56] References Cited

U.S. PATENT DOCUMENTS

| | | | |
|---|---|---|---|
| 455,151 | 6/1981 | Bartlett | 239/259 |
| 2,108,787 | 2/1938 | Coles et al. | 239/256 |
| 2,586,517 | 2/1952 | Coles | 239/DIG. 1 X |
| 3,357,644 | 12/1967 | Penfield et al. | 239/258 X |
| 3,630,450 | 12/1971 | Stephany | 239/242 |
| 3,921,912 | 11/1975 | Hayes | 239/242 |
| 4,175,575 | 11/1979 | Cushing | 239/255 |
| 4,550,630 | 11/1985 | Remus | 74/800 |

FOREIGN PATENT DOCUMENTS

| | | | |
|---|---|---|---|
| 65902 | 3/1943 | Norway | 239/251 |
| 93509 | 1/1959 | Norway | 239/DIG. 1 X |
| 1287105 | 8/1972 | United Kingdom . | |
| 630018 | 9/1978 | U.S.S.R. | 239/227 |
| 931228 | 6/1982 | U.S.S.R. . | |

*Primary Examiner*—Andres Kashnikow
*Assistant Examiner*—Mary Beth O. Jones
*Attorney, Agent, or Firm*—Murray and Whisenhunt

[57] ABSTRACT

A sprinkler device including a body on which a tubular spindle is mounted for rotation about a rotational axis relative to the body. The spindle has a fluid inlet in the region of the body and includes a slanted portion projecting from the body at an angle to the rotational axis. A head is rotatably mounted on the slanted portion of the spindle in engagement with the body and includes a fluid discharge member which communicates with the interior of the tubular spindle. The slanted portion of the spindle and the engagement of the head with the body are such that when the spindle rotates relative to the body, the head and the discharge member rotate relative to the body about the rotational axis and also oscillate in a longitudinal direction with respect to the rotational axis during rotation about the rotational axis.

18 Claims, 21 Drawing Figures

SPRINKLERS

This invention relates to sprinklers and more particularly to sprinklers suitable for irrigation purposes.

According to the invention sprinkler means includes a body; a tubular spindle mounted on the body and adapted to be rotatable about a rotational axis relative to the body, the tubular spindle having a fluid inlet in the region of the body and including a slanted portion projecting from the body at an angle to the rotational axis of the tubular spindle, a head rotatably mounted on the slanted portion of the tubular spindle and in engagement witb the body; and fluid discharge means from the head in communication with the interior of the tubular spindle, the slanted portion of the tubular spindle and the engagement of the head with the body being arranged such that upon rotation of the tubular spindle relative to the body or upon rotation of the head relative to the tubular spindle, the head and the discharge means are caused at least to oscillate in a longitudinal direction with respect to the rotational axis of the tubular spindle. Preferably, the slanted portion of the tubular spindle and the engagement of the head with the body are arranged such that upon rotation of the tubular spindle relative to the body or upon rotation of the head relative to the tubular spindle, the head and the discharge means are caused to rotate relative to the body about the rotational axis of the tubular spindle and also to oscillate in a longitudinal direction with respect to the rotational axis of the tubular spindle during rotation about the rotational axis.

Preferably, the body is adapted to be mounted such that the rotational axis of the annular spindle is disposed generally upright. With such an arrangement the discharge means may be arranged to rotate about the upright rotational axis of the spindle and also to oscillate up and down during rotation about the upright rotational axis. It will be appreciated that the trajectory of fluid discharged from the head will change continuously in a horizontal direction and also in a vertical direction.

The oscillation of the head may be such that the discharge means may have a component of movement transversely to the rotational axis of the tubular spindle in addition to a component of movement longitudinally with respect to the rotational axis.

This will enhance the fluid coverage of the area over which fluid is distributed by the discharge means.

Preferably, the frequency of oscillation of the head is greater than the frequency of rotation of the head.

The head may be in geared engagement with the body. Any suitable interengageable gear teeth may be provided on the body and the head. A set of gear teeth disposed in annular formation on the body about the spindle may be interengageable with a set of gear teeth disposed in annular formation on the head about the spindle.

The number of teeth in the set of gear teeth on the bead may be equal to the number of teeth in the set of gear teeth of the body so that the gear ratio is 1:1. With such a gear ratio, the head and discharge nozzle will not rotate about the rotational axis of the tubular spindle but will only oscillate in a longitudinal direction with respect to the rotational axis of the tubular spindle.

Preferably, there is a difference in the number of teeth in the set of gear teeth on the head and the number of teeth in the set of gear teeth on the body so that a gear ratio other than 1:1 is provided. With such a gear ratio, the head and discharge nozzle not only oscillate in a longitudinal direction with respect to the rotational axis of the tubular spindle, but also rotate about the rotational axis.

If the number of teeth on the head is greater than the number of teeth on the body, the head will rotate in the same direction as the tubular spindle. If on the other hand, the number of teeth on the head is smaller that the number of teeth on the body, the head will rotate in a direction opposite to the tubular spindle. This feature may be utilized to provide reversible rotation of the head and discbarge means through a predetermined angle.

The gear ratio may be such that the frequency of oscillation is higher than the frequency of rotation.

There may be a small difference of say one or two between the number of teeth on the head and the number of teeth on the body.

For example, the rat io between the number of gear teeth on the head and the number of gear teeth on the body may be 100:99. With such a gear ratio the head will go tbrough 100 cycles of oscillation for every one cycle of rotation through 360° about tbe rotational axis.

With such a gear ratio a substantially circular area may be irrigated.

By suitable selection of the angle between the longitudinal axis of the slanted upper portion of the tubular spindle and the axis of rotation of the spindle and the gear ratio between the number of gear teeth on the head and the body, a substantially square or triangular area or an area of other suitable shape may be irrigated.

Thus if the gear ratio is 1.25:1 and the angle between the longitudinal axis of the slanted upper part of the tubular spindle and the rotational axis is about 10° a substantially square area may be irrigated. With such an arrangement the head will go tbrough four cycles of oscillation for every one cycle of rotation through 360° about the rotational axis.

If the gear ratio is 1.33:1 and the angle between the longitudinal axis of the slanted upper portion of the tubular spindle and the rotational axis is about 15°, a substantially triangular area may be irrigated. With such an arrangement the head will go through three cycles of oscillation for every one cycle of rotation through 360° about the rotational axis.

The discharge means may comprise a suitable nozzle or outlet port on or in the head.

One or more discharge means may be provided on the head.

Where two or more discharge means are provided they may be directed outwardly away from the head at different angles to the slanted portion of the tubular spindle so that fluid issuing from the different discharge means is distributed over different ground areas.

Any suitable means may be provided rotatably to drive the tubular spindle about its rotational axis under the action of a flow of fluid under pressure through the sprinkler.

In one embodiment of the invention, the slanted portion of the tubular spindle may protrude from the head; and a rearwardly facing aperture may be provided through the wall of the protruding part of the slanted portion of the tubular spindle, the reaction of fluid under pressure issuing from the aperture causing rotation of the tubular spindle relative to the body.

In another embodiment of the invention, the drive means may comprise a reaction element or surface fast with the body, and a port adapted to direct fluid under pressure onto the reaction element or surface, the action of fluid under pressure impinging on the reaction element or surface fast with the body causing rotation of the spindle relative to the body.

Alternatively, the drive means may comprise a reaction element or surface fast with the head; and a port adapted to direct fluid under pressure onto the reaction element or surface, the action of fluid under pressure impinging on the reaction element or surface fast with the head causing rotation of the head relative to the slanted portion of the spindle and such rotation in conjunction with the engagement of the head with the body, causing rotation of the spindle and the head about the rotational axis of the spindle.

For a clear understanding of the invention preferred embodiments will now be described purely by way of example with reference to the accompanying drawings in which:

FIG. 18 is an elevational view in section of still another embodiment of an irrigation sprinkler according to the invention.

Figures 1, 2:
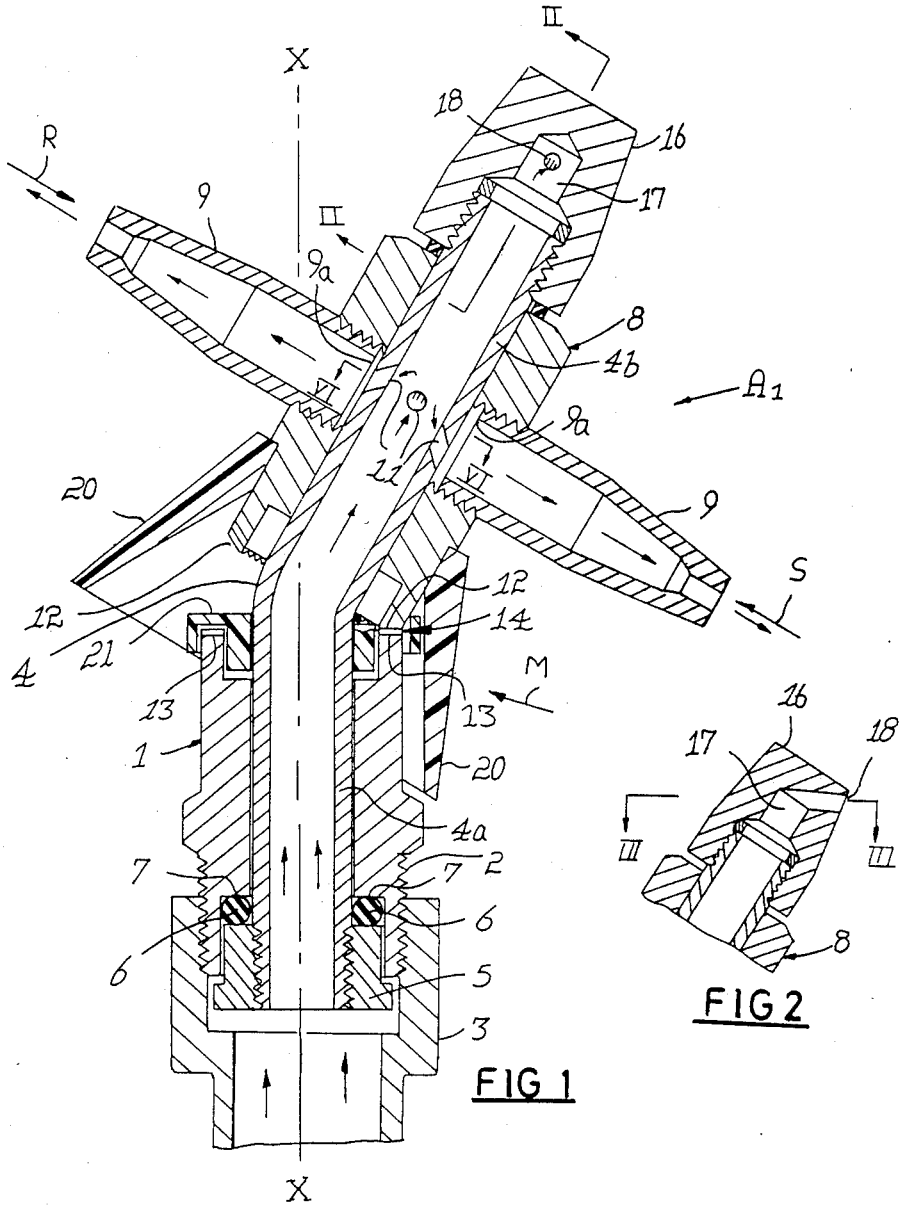
FIG. 1 is an elevational view in section of one embodiment of an irrigation sprinkler according to the invention.
FIG. 2 is a section on the line II—II in FIG. 1 illustrating the fluid drive means for the sprinkler.
Figure 3:
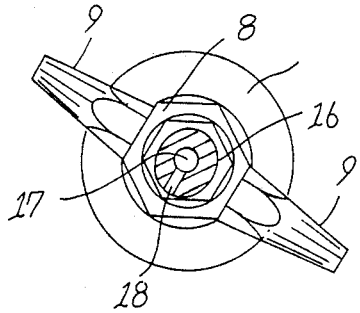
FIG. 3 is a section on the line III—III in FIG. 2.

Referring first to FIGS. 1 to 8, the sprinkler $A_1$ comprises tubular body 1 which is provided with an external screw thread 2 at its lower end for releasable screw engagement with a rigid water supply conduit 3 which is adapted to mount the sprinkler $A_1$ in an upright operative position.

The lower part 4*a* of a tubular spindle 4 is rotatably located in the bore of tubular body 1 and is screw threaded externally at its lower end for engagement with an internal screw thread in sleeve 5. An O-ring 6 of any suitable material which is adapted frictionally to control the rotation of tubular spindle 4 relative to body 1, is trapped between sleeve 5 and a circumferential shoulder formation 7 in the bore of body 1. Water under pressure can enter the bore of tubular spindle 4 at the lower end of its lower portion 4*a* from water supply conduit 3. Engagement of the inner end of sleeve 5 with O-ring 6 which, in turn, engages shoulder 7 in body 1, prevents upward displacement of tubular spindle 4 out of body 1 under the influence of the water pressure.

The upper portion 4*b* of tubular spindle 4 protrudes upwardly from body 1 and is slanted relative to the lower portion 4*a*. Tubular spindle 4 is rotatable relative to body 1 about the substantially vertical axis X—X shown in FIG. 1. It will be seen that the slanted upper portion 4*b* of tubular spindle 4 projects from body 1 at an angle to the rotational axis X—X.

It will be appreciated that when tubular spindle 4 rotates about rotational axis X—X, its slanted upper portion 4*b* describes an inverted conical path about axis X—X.

A tubular head B is rotatably mounted on the slanted upper portion 4*b* of tubular spindle 4 so that head 8 can rotate relative to the upper slanted portion 4*b* about the longitudinal axis of the latter and can also rotate about the vertical axis X—X. It will be seen that due to the slant of upper spindle portion 4*b*, head 8 is tilted relative to vertical rotational axis X—X.

Figure 6:
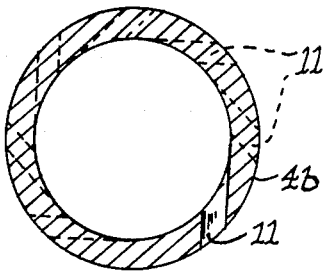
FIG. 6 is an enlarged section on the line VI—VI in FIG. 1 of the tubular spindle of the sprinkler, illustrating the circumferentially spaced fluid outlets from the tubular spindle to the discharge nozzles.
Figure 7:
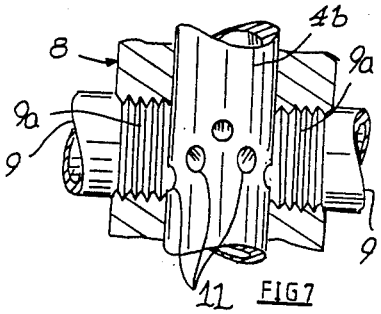
FIG. 7 is a fragmentary elevational view of the tubular spindle, illustrating the circumferential and vertical relationship of the fluid outlets round the periphery of the tubular spindle.

A pair of discharge nozzles are mounted in diametrically opposed oppositions on head 8 in communication with the bore of the upper spindle portion 4*b*. In the zones of the inner ends 9*a* of discharge nozzles 9 respectively, a series of circumferentially spaced and vertically offset outlet apertures 11 extend downwardly and tangentially through the wall of upper spindle part 4*b* as shown in FIGS. 1, 6 and 7. Water under pressure which flows upwardly along tbe bore of tubular spindle 4 can pass from spindle 4 through outlet apertures 11 and into discharge nozzles 9 from where the water is discharged.

A set of say 100 gear teeth 12 are provided on the lower end of head 8 in annular formation about tubular spindle 4 and is adapted to engage with a set of say 99 gear teeth 13 which are provided on the upper end of body 1 in annular formation about tubular spindle 4. The gear ratio of head 8 to body 1 is therefore 100:99. The gear teeth 12 are inclined to the longitudinal axis of head 8 and gear teeth 13 are inclined to the longitudinal axis of body 1. Due to the tilt of head 8 the teeth 12 and 13 mesh in a localised circumferential zone 14 at any instant in time as can best be seen in FIG. 4. This circumferential zone is located under the bend in spindle 4.

A hollow cap 16 having a blind bore 17 and a discharge port 18 which is in communication with bore 17, is in screw threaded engagement with the upper end of upper spindle portion 4*b* so that cap 16 is rotatable with tubular spindle 4. It will be seen that discharge port 18 is suitably orientated relative to the slant of spindle 4 so that when water under pressure which flows along the bore of tubular spindle 4 past the outlet apertures 11, discharges under pressure from discharge port 18, the reaction of this discharge of water causes displacement of the slanted upper portion 4*b* of spindle 4 and thereby to cause rotation of spindle 4 relative to body 1 about rotational axis X—X.

When tubular spindle 4 is rotatably driven by the discharge of water from discharge port 18 in head 16, the rotation of the slanted upper portion 4*b* of the tubular spindle 4 and the engagement of the teeth 12 on head 8 with the teetb 18 on body 1, cause the disposition of head 8 and of the discharge nozzles 9 relative to the vertical axis X—X to change continuously as the slanted upper portion 4*b* of tubular spindle 4 rotates about vertical axis X—X and at the same time cause head 8 and the discharge nozzles 9 thereon to rotate about the vertical rotational axis X—X with the engagement zone 14 between gear teeth 12 and 13 running along a closed path round vertical axis X—X. The result is that head 8 and its discharge nozzles 9 rotate about vertical axis X—X and also oscillate up and down longitudinally with respect to vertical axis X—X during rotation of head 8 about this axis. The oscillatory movement of the discbarge nozzles 9 may be such that when they are viewed in the directions of arrows R and S in FIG. 1, nozzles 9 follow a somewhat winding or spiral-like path such that in addition to an oscliatory component of movement longitudinally with respect to vertical rotational axis X—X, it also has an oscillatory component of movement transversely to the vertical rotational axis.

Due to the difference of one tooth between the number of gear teeth 12 on head 8 and the number of gear teeth 13 on body 1, the speed of rotation of discharge nozzles 9 about vertical axis X—X will be much slower than the speed of rotation of annular spindle 4 about vertical axis X—X so that for every 100 complete revolutions of tubular spindle 4 about vertical axis X—X, nozzles 9 will only complete a single revolution about vertical axis X—X. Also, the frequency of oscillation of nozzles 9 will be much higher than the frequency of rotation of nozzles 9 about vertical axis X—X so that nozzles 9 will go through 100 cycles of oscillation for every one cycle of rotation through 360° about vertical axis X—X.

It will be appreciated that as nozzles 9 rotate about vertical axis X—X and oscillate up and down during their rotation about vertical axis X—X, the trajectories of the jets of water discharged from discharge nozzles 9 change continuously in a horizontal direction and also in a vertical direction so that water is distributed from each of the nozzles over a ground area lying within the circumference of a circle. The outer radius of the circle within which water is distributed by the nozzles 9 will depend on the pressure on which the water issues from the discharge nozzle in question, the angle in a vertical direction through which the discharge mouth of the nozzles oscillate and possibly also on the speed of rotation of the nozzles about vertical axis X—X. Discharge port 18 in cap is so arranged in relation to nozzles 9 that the water discharged from port 18 is distributed over an annular ground area extending round and adjoining the circular area irrigated by water issuing from nozzles 9.

It will be appreciated that when a nozzle 9 is in its lowes downwardly tilted position as shown with reference to the right hand nozzle 9 in FIG. 1, there is a danger of plants being damaged and the soil surface being disturbed if the pressure of water discharged from the downwardly tilted nozzle is too high. If the discharge pressure is kept constant at a level to suit circumstances when the nozzle is in its lowest downwardly tilted position, the radius of the outer circle to which water will be distributed by a nozzle when it is in its highest upwardly tilted position as shown with reference to the left hand nozzle 9 in FIG. 1, will not be as great as will be obtained with a higher discharge pressure.

In order to avoid or at least to minimize this disadvantage, the outlet ports 11 from the upper spindle part 4*a* are spaced circumferentially and are also vertically offset as can best be seen in FIG. 7. The vertical spread of tbe outlet ports 11 is substantially equal to the diameter of the inner ends 9*a* of discharge nozzles 9.

Figure 8:
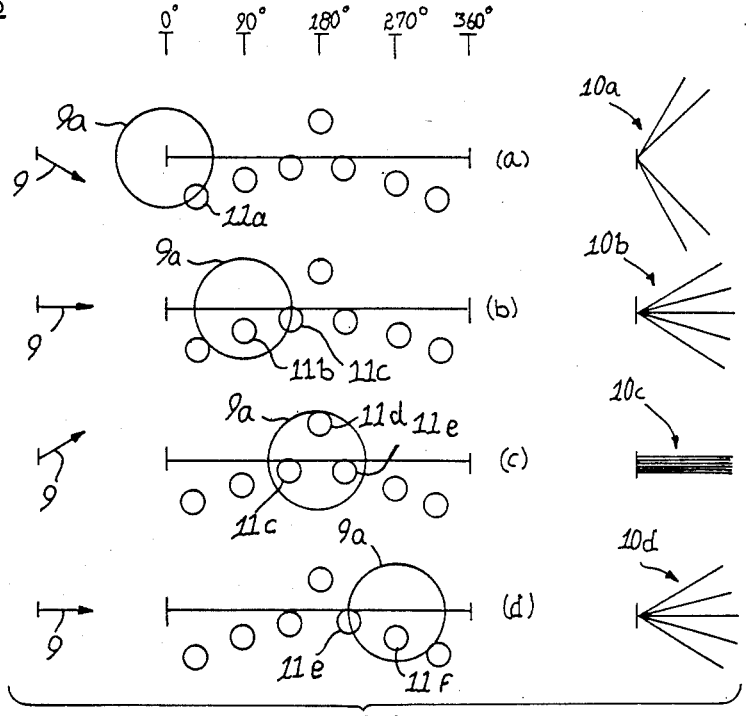
FIG. 8 shows four diagrammatic developed views of the tubular spindle illustrating four circumferential positions of the fluid outlets from the tubular spindle relative to the fluid inlet to a discharge nozzle during a complete revolution of the tubular spindle through 360°.

Referring to FIG. 7 and to the diagrammatic representation of FIG. 8, it will be seen that the arrangement of outlet apertures 11 is such that when a nozzle 9 is in its lowest downwardly tilted position, only a portion of only one outlet aperture 11*a* is located in registration with the inner end 9*a* of the bore of nozzle 9 as shown in FIG. 8*a*, so that water is introduced into the nozzle 9 at a suitably low pressure to provide a suitable water discharge 10*a* from nozzle 9 that will not damage plants or disturb the soil. Due to the downward and tangential disposition of outlet apertures 11, water flows spirally along nozzle 9 and issues in a fine spray which irrigates the ground in the immediate proximity of the sprinkler $A_1$.

As the spindle 4 rotates through 90° relative to head 8, it will be seen from FIG. 8*b* that when nozzle 9 is in a substantially horizontal position, the whole of outlet port 11*b* and portion of outlet port 11*c* are in registration with the bore of nozzle 9 as shown in FIG. 8*b*, so that water is introduced into nozzle 9 at a higher pressure to provide a required water discharge 10*b* to suit circumstances.

As tubular spindle 4 rotates further through another 90° relative to head 8, it will be seen from FIG. 8*c* that when nozzle 9 is in its highest upwardly tilted position, the whole of three outlet ports 11*c*, 11*d* and 11*e* are in registration with the bore of nozzle 9 so that water is introduced into nozzle 9 at a still higher pressure to provide a required water discharge 10*a* to suit circumstances.

As spindle 4 rotates further through another 90° relative to head 8, it will be seen from FIG. 8*d* that when nozzle 9 has moved downwardly again to a substantially horizontal position, the whole of outlet port 11*f* and portion of outlet port 11*e* are in registration with the bore of nozzle 9 so that water is introduced into nozzle 9 at a lower pressure to provide a required water discharge 10*d* similar to discharge 10*b* of FIG. 8*b*.

After a complete revolution of spindle 4 relative to head 8 through 360°, nozzle 9 is again in its lowest downwardly tilted position and the relationship between the outlet ports 11 and the bore of nozzle 9 is again the same as that described above with reference to FIG. 8*a*.

It will be appreciated that the pressure of water discharging from a nozzle 9 is varied continuously from a mimimum to a maximum value and back again to mimimum value as the nozzle 9 moves from its lowest downwardly tilted position to its highest upwardly tilted position and back again to it lowest downwardly tilted position. The circumferential position of cap 16 and of discharge port 18 relative to the upper spindle portion 4*b* may be varied by screwing cap 16 in the one or the other direction relative to spindle 4, thereby to vary the direction relative to upper spindle portion 4*b* in which discharge port 18 faces and to vary the speed at which spindle 4 is rotatably driven relative to body 1 by the reaction of water charged through discharge port 18.

Figure 9:
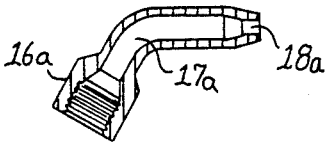
FIG. 9 is a longitudinal sectional view of an alternative arrangement of fluid drive means for the sprinkler.

Any suitable arrangement of discharge nozzle or port other than that of cap 16 may be used for rotatably driving spindle 4 relative to body 1 under the influence of the reaction of a discharge of water under pressure. Thus, as shown in FIG. 9, there may be provided a cap 16*a* which is adapted to be screwed onto the upper end of the upper spindle portion 4*b* and which is provided with a discharge nozzle 18*a* which is adapted to discharge water in a suitable direction relative to the slanting upper portion 4*b* of spindle 4.

When water under pressure is introduced into the bore of tubular spindle 4 from water supply conduit 3, an upward pressure is exerted on spindle 4 so that the inner end of sleeve 5 on spindle 4 is urged into frictional engagement with O-ring 6 which, in turn, is urged into frictional engagement with shoulder formation 7 in body 1, to exert a frictional restraint on the rotation of the spindle 4 relative to body 1. With an increase in water pressure, the discharge pressure from discharge port 18 and the speed of rotation of spindle 4 increases. However, O-ring 6 is resiliently compressible and the increase in water pressure causes a flattening of O-ring 6 which increases its areas of contact with body 1 and sleeve 5 and increases the frictional engagement of O-ring 6 with body 1 and sleeve 5, thereby to increase the frictional restraint O-ring 6 exerts on the rotation of spindle 3 relative to body 1.

O-ring 6 is also capable of moving back to its normal configuration with reducing water pressure to decrease its area of contact with body 1 and sleeve 5 and decrease its frictional engagement with body 1 and sleeve 5, thereby to decrease the frictional restraint it exerts on the rotation of spindle 3 relative to body 1.

The frictional engagement of O-ring 6 with body 1 and sleeve 5 varies with the pressure of the water introduced into spindle 4 and automatically controls the speed of rotation of spindle 4 relative to body 1 in accordance with the water pressure.

Figure 10:
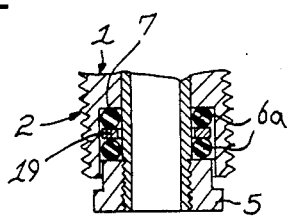
FIG. 10 is a fragmentary vertical sectional view of the lower part of the body of the sprinkler, illustrating a different arrangement of rotation control rings.

Instead of a single O-ring 6 to control the rotation of spindle 4, any suitable arrangement of annular friction elements having any suitable cross-sectional configuration may be located between sleeve 5 and shoulder formation 7 in body 1. Thus, as shown in FIG. 10, a pair of O-rings 6*a* between which a flat friction ring 19 of rectangular cross-sectional area is interposed, may be provided. A resiliently compressible, annular friction element, such as O-ring 6, may be made of synthetic plastics material and may have a shore hardness of about 80.

It will be appreciated that many other variations in detail are possible. For example, as shown in FIG. 1, an outwardly and downwardly flaring protective skirt 20 which is mounted on head 8, may be provided round the two sets of gear teeth 12, 13 to protect them from dirt during use.

Figure 4:
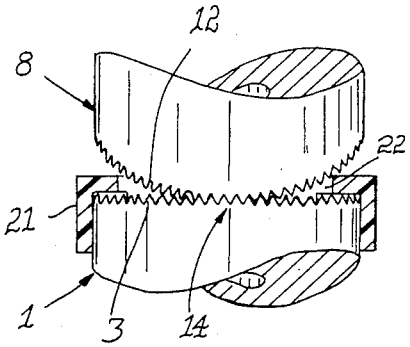
FIG. 4 is a fragmentary side view in the direction of arrow M in FIG. 1 with the protective skirt removed, illustrating the geared engagement between the head and the body of the sprinkler.
Figure 5:
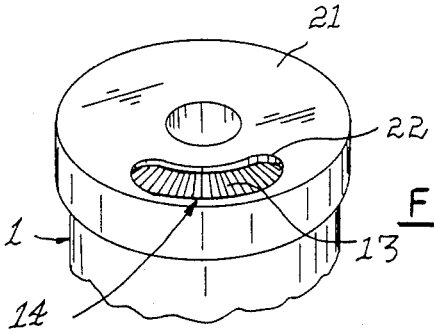
FIG. 5 is a perspective view with parts omitted, of the body of the sprinkler, illustrating the protective cap for the gear teeth of the body.

Also, as shown in FIGS. 1, 4 and a protective cap 21 may be located over the upper end of body 1 to protect the set of teeth 13 from dirt. To permit engagement of teeth 12 and 13 in the localised circumferential zone 14, cap 21 may be provided with an arcuate aperture 22 which exposes teeth 13 in the zone 14. Cap 21 may fit tightly on spindle 4 to rotate with spindle 4 so that aperture 22 is caused to rotate along teeth 13 with the engagement zone 14.

Figure 11:
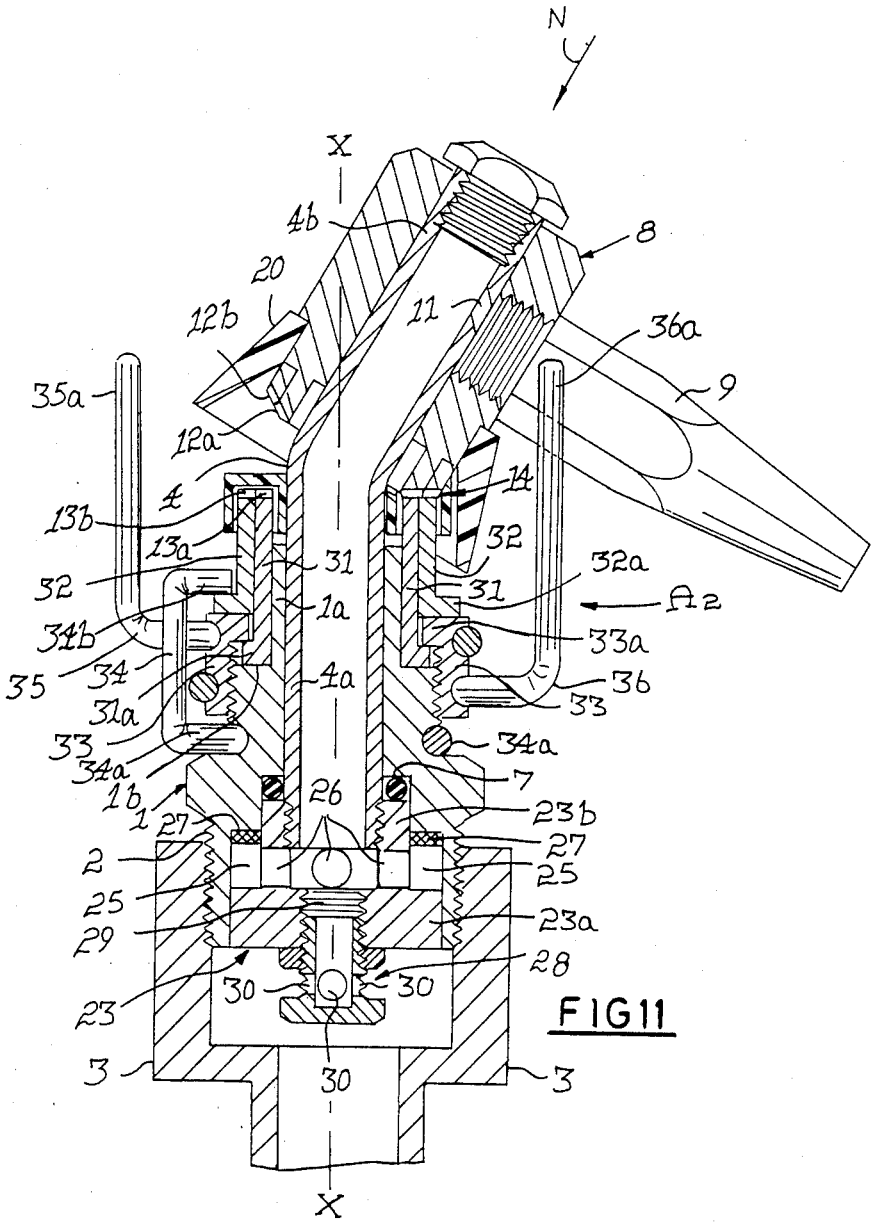
FIG. 11 is an elevational view in section of another embodiment of an irrigation sprinkler according to the invention, which is adapted to be reversibly rotatable through a predetermined angle.
Figure 12:
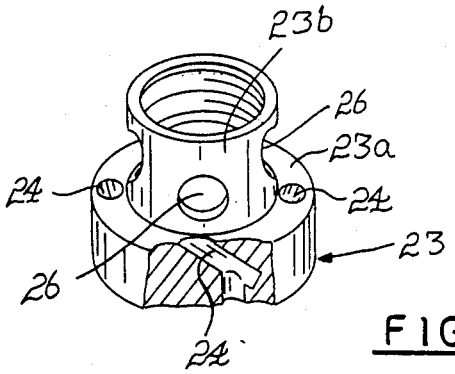
FIG. 12 is a perspective view with a part broken away, of the jet element of the fluid drive of the sprinkler of FIG. 11.
Figure 13:
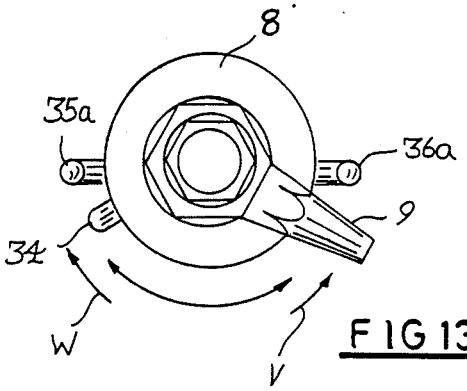
FIG. 13 is an end view in the direction of arrow N in FIG. 11 of the rotary head and discharge nozzle of the sprinkler of FIG. 11, illustrating the relationship between the discharge nozzle and a pair of circumferentially spaced rotation reversing stops on the body of the sprinkler.

Referring now to FIGS. 11 to 13 sprinkler $A_2$ operates on the same basic principle as the sprinkler $A_1$ of FIGS. 1 to 10, with certain exceptions that will now be described below.

The operative movement of sprinkler $A_2$ is obtained by rotatably driving the lower end of the lower portion 4*a* of tubular spindle 4 by means of a fluid drive including a jet element 23 which is screwed onto the externaly threaded lower end of lower spindle portion 4*a* for rotation therewith and which is located in the lower end of body 1 for rotation relative thereto. Circumferentially spaced passages 24 extend upwardly through the lower flange portion 23*a* of jet element 23 and are adapted to pass water under pressure from supply conduit 3 into an annular chamber 25 located within body 1 round the upper tubular portion 23*b* of jet element 23. The upper tubular portion 23*b* of jet element 23 has circumferentially spaced passages 26 through its wall through which water can flow from annular chamber 25 into the bore of lower spindle portion 4*a*.

An annular reaction formation 27 of mesh material is located in the upper region of chamber 27 and is fast with body 1. The upper portions of passages 24 in flange portion 23*a* of jet element 23 are inclined to the axis of jet element 23 so that water under pressure which issues into chamber 25 from passages 24 impinges on the reaction element 27 at an acute angle, thereby to cause rotation of jet element 23 and spindle 4 relative to body 1.

In order to vary the speed of rotation, there may be provided a tubular by-pass element 28 which is screwed into a threaded aperture 29 extending upwardly through the base of jet element 23. Circumferentially spaced apertures 30 places the bore of by-pass element 28 in communication with water supply conduit 8. The upper end of the bore of by-pass element 28 communicates with the lower end of the bore of lower spindle portion 4*a* through aperture 29 and the bore of the upper tubular portion 23*b* of jet element 23.

By unscrewing by-pass element 28 to tbe position shown in FIG. 11 in which the passages 30 are completely unobstructed, a maximum of water can flow directly into the bore of spindle 4 and annular chamber 25 and reaction element 27, so that spindle 4 is driven at minimum speed. By screwing by-pass element 28 into jet element 23, the passages 30 become obstructed by entry into aperture 29, whereby to reduce the amount of water that by-passes reaction element 27 so that the speed of rotation of spindle 4 is increased until a maximum speed is reached when passages 30 are obstructed completely and a maximum flow of water through chamber 25 is obtained.

Rotation of spindle 4 causes head 8 and discharge nozzle 9 to rotate about the vertical rotational axis X—X of spindle 4 and also to oscillate up and down longitudinally with respect to the vertical axis X—X during rotation about this axis.

An inner ring of gear teeth 12*a* and also an outer ring of gear teeth 12*b* are fast with the lower end of head 8. An inner ring of gear teeth 13*a* is fast with the upper end of an inner sleeve 31 which is rotatably mounted round the upper portion 1*a* of body 1. An outer ring of gear teeth 13*b* is fast with the upper end of an outer sleeve 32 which is rotatably mounted round inner sleeve 31. The teeth 12*a* on head 8 are interengageable with and are greater in number than teeth 13*a* on body 1. The teeth 12*b* on head 8 are interengageable with and are smaller in number than teeth 13*b* on body 1.

Inner sleeve 31 has a bottom flange 31*a* adapted to seat on circumferential shoulder 1*b* of body 1. An internally threaded sleeve 33 provided with an inwardly directed flange 33*a*, is in screw-threaded engagement with body 1. Flange 33*a* of tbreaded sleeve 33 is adapted to engage flange 31*a* of inner sleeve 31. Outer sleeve 32 has a bottom flange 32*a* adapted to engage the upper end of threaded sleeve 38.

An elongate element 34 has a lower portion 34*a* that clips firmly round body 1 in a circumferential groove in the body and has an upper, inwardly directed portion 34*b* constituting a stop formation engageable by bottom flange 32*a* of outer sleeve 32. Two further elongate members 35 and 36 are also clipped firmly round body 1 and present upstanding and circumferentially spaced stop formations 35*a*, 36*a* respectively which are engageable by nozzle 9.

In use, spindle 4 is rotated in an anti-clockwise direction as shown by arrow V in FIG. 13 when viewed from the top. If threaded sleeve 33 is screwed down so that the bottom flange 31*a* of inner sleeve 31 is clamped between flange 32*a* on threaded sleeve 33 and shoulder 1*b* on body 1, the inner teeth 13*a* are locked to body 1, and held stationary. Outer sleeve 32 and its teeth 13*b* is then freely rotatable relative to body 1. As there are more teeth 12*a* on head 8 than there are teeth 13*a* on inner ring 31, head 8 and nozzle 9 are caused to rotate in the same direction as spindle 4, namely in an anti-clockwise direction.

Head 8 and nozzle 9 will continue to rotate in an anti-clockwise direction until nozzle 9 reaches and engages stop formation 36*a* to displace it in an anti-clockwise direction. Stop formation 36*a* is fast with threaded sleeve 33 and this anti-clockwise displacment of stop formation 36*a* acts to screw threaded sleeve 33 upwardly, thereby to release inner ring 31 so that inner teeth 13*a* are freely rotatable relative to body 1 and to clamp bottom flange 32*a* of outer sleeve 32 against stop formation 34*b*. Outer teeth 13*b* are then locked to body 1 and are held stationary.

As there are less teeth 12*b* on head 8 than there are teeth 13*b* on outer ring 32, head 8 and nozzle 9 are caused to rotate in an opposite direction to that in which spindle 4 rotates, namely in a clockwise direction as shown by arrow W in FIG. 13. The direction of rotation of head 8 and nozzle 9 is therefore reversed.

Head 8 and nozzle 9 will continue to rotate in a clockwise direction until nozzle 9 reaches and engages stop formation 35*a* to displace it in a clockwise direction. Stop formation 35*a* is fast with threaded sleeve 33 and this clockwise displacement of stop formation 35*a* acts to screw threaded sleeve 33 downwardly, thereby to release outer ring 32 so that outer teeth 13*b* is again freely rotatable relative to body 1 and to clamp bottom flange 31*a* of inner ring 31 against body 1. Inner teeth 13*a* are then locked to body 1 and are held stationary. This causes the direction of rotation of head 8 and nozzle 9 to be reversed.

It will be appreciated that nozzle will have a reciprocatory rotational movement about vertical axis X—X through an angle determined by the circumferential spacing between stop formations 35*a* and 36*a*.

Figure 14:
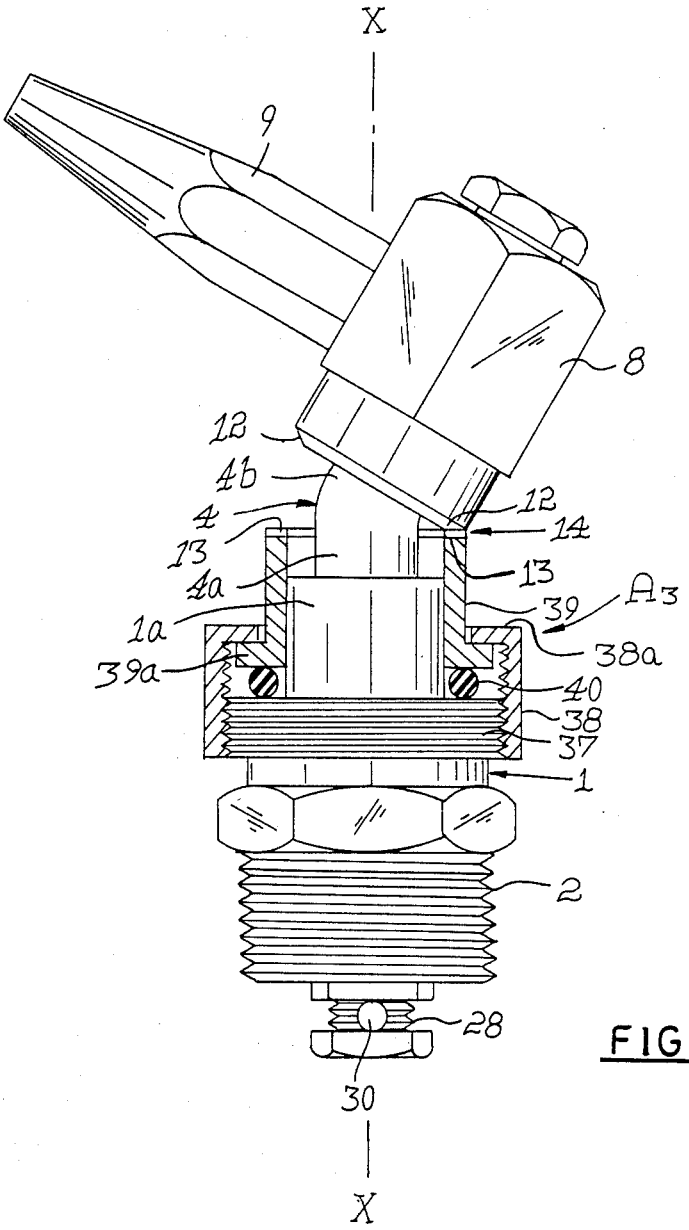
FIG. 14 is an elevational view partly in section of another embodiment of an irrigation sprinkler according to the invention.

In the arrangement of FIG. 14, the fluid drive means for operatively rotating spindle 4 of sprinkler $A_3$ is similar to that of FIGS. 11 and 12 and the water supply from spindle 4 to nozzle 9 is similar to that described above with reference to FIGS. 6, 7 and 8. The upper end of body 1 is screw threaded externally at 37 and an internally threaded sleeve 38 with an inwardly directed flange 38*a* is in screw threaded engagement with threaded portion 37 of body 1. A ring of teeth 13 is fast with the upper end of sleeve 39 which is rotatably mounted on body portion 1*a* and has an outwardly directed flange 39*a* engageable by flange 38*a* of sleeve 38. An O-ring 40 of suitable friction material is located between flange 39*a* of sleeve 39 and the threaded portion 37 of body 1.

A ring of teeth 12 is fast with the lower end of body 8. Teeth 12 are adapted to engage teeth 13. The teeth 12 are one more in number than the teeth 13.

Sleeve 38 can be screwed downwardly to clamp flange 39*a* of sleeve 39 tightly against O-ring 40 and lock teeth 13 to body 1. Sprinkler $A_3$ will then operate in similar manner to sprinkler $A_1$ of FIGS. 1 to 8 with head 8 and nozzle 9 rotating in the same direction as spindle 4.

However, sleeve 38 may be unscrewed slightly to release the clamping pressure slightly so that without ring 39 and teeth 13 being able to rotate freely relative to body 1, a certain amount of slip between teeth 13 and body 1 can occur. The result is that as spindle 4 is rotated, head 8 and nozzle 9 are caused to rotate uni-directionally in the same direction as spindle 4 about vertical axis X—X and teeth 13 are slowly dragged along with head 8 to rotate about vertical axis X—X in the same direction as head 8, but at a speed of rotation which is much less than that of head 8. The frequency of up and down oscillation of nozzle 9 longitudinally with respect to vertical axis X—X is reduced.

Figure 15:
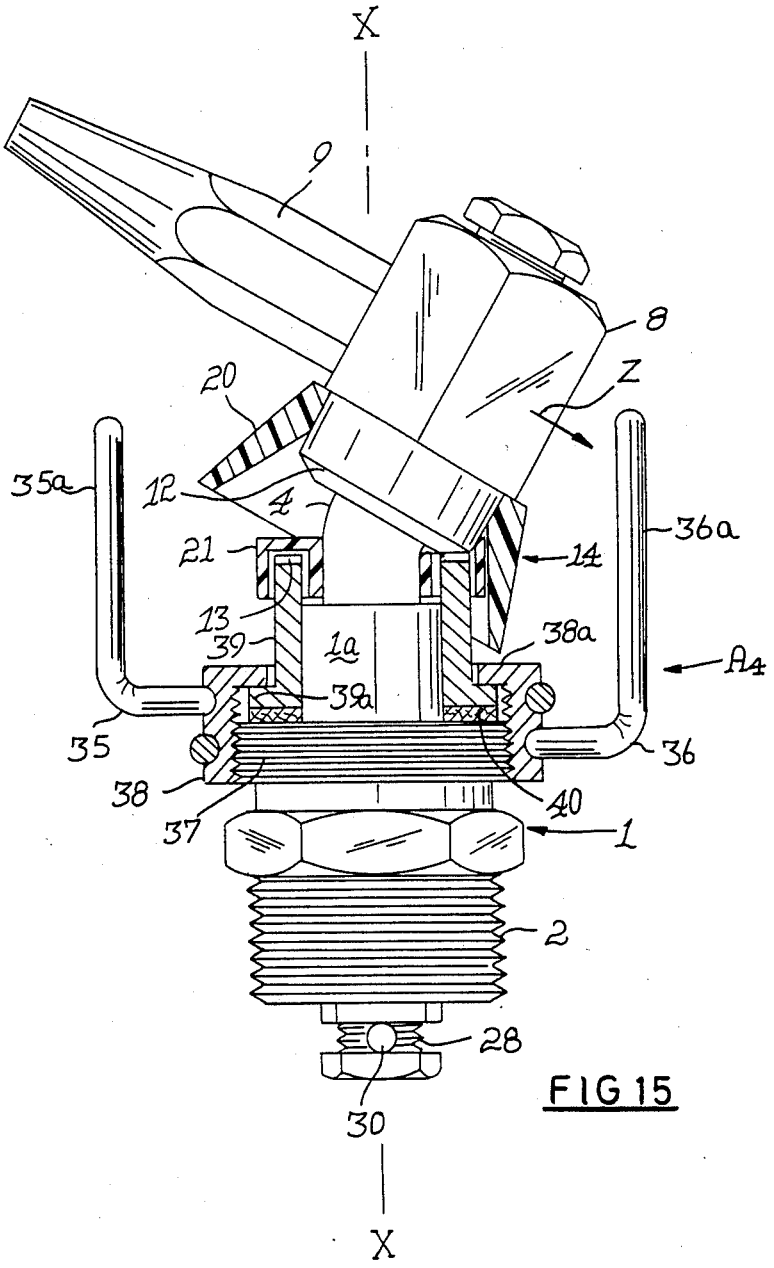
FIG. 15 is an elevational view partly in section of yet another embodiment of an irrigation sprinkler according to the invention.

The result is that the movement of nozzle 9 is such that it directs water along a spiral path which decreases from a maximum to a minimum radius as the nozzle moves from its highest upwardly directed position to its lowest downwardly directed position and then increases again from a minimum to a maximum radius as the nozzle moves from its lowest downwardly directed position to its highest upwardly directed position. The arrangement of sprinkler $A_4$ of FIG. 15 is similar to that of sprinkler $A_3$, with the exception that sprinkler $A_4$ is arranged to be reversibly rotatable through a predetermined angle.

The teeth 12 on head 8 of sprinkler $A_4$ are one less in number than the teeth 13 on body 1, so that in use head 8 and nozzle 9 will rotate in a direction opposite to spindle 4 when sleeve 38 is screwed down to clamp flange 39*a* of sleeve 39 against annular friction pad 40 and lock teeth 13 to body 1.

If spindle 4 rotates in a clockwise direction when viewed from the top and sleeve 38 has been screwed down to lock teeth 13 to body 1, head 8 and nozzle 9 will rotate in an anti-clockwise direction until nozzle 9 engages stop formation 36*a* to displace the latter in an anti-clockwise direction. This causes sleeve 38 to be screwed upwardly to allow slippage between teeth 13 and body 1. Teeth 13 is then capable of restrained rotation relative to body 1.

The reaction in the direction of arrow Z which is caused by water issuing from nozzle 9, urges head 8 in a radial direction into frictional engagement with spindle 4 so that rotation of spindle 4 in an a clockwise direction tends to drag head 8 along with it in a clockwise direction. Such a rotation of head 8 in the same direction as spindle 4 is permitted by the slippage between teeth 13 and body 1. The direction of rotation of head 8 and nozzle 9 is therefore reversed.

Clockwise rotation of head 8 with spindle 4 will continue until nozzle 9 engages the other stop formation 35*a* to displace the latter in a clockwise direction. This causes sleeve 38 to be screwed down to lock teeth 13 to body 1 so that head 8 and nozzle 9 again rotates in a direction opposite to spindle 4. The direction of rotation of head 8 and nozzle 9 is therefore reversed again.

Nozzle 9 will have a reciprocatory rotational movement about vertical axis X—X through an angle determined by the circumferential spacing between stop formations 35*a* and 36*a*.

Referrring now to FIG. 16, sprinkler $A_5$ operates on the same basic principle as the sprinkler $A_1$ of FIGS. 1 to 10 with certain exceptions that will be described below.

The supply of water under pressure from tubular spindle 4 to nozzle 9 is different. Spindle 4 is provided with circumferentially spaced apertures 41 which pass substantially at right angles to the longitudinal axis of upper spindle portion 4*b* through the wall of spindle 4 and communicates with annular chamber 42 in head 1 which surrounds spindle 4. The bore of nozzle 9 is in communication with chamber 42. During rotation of spindle 4 relative to head 8, water under pressure can pass from tbe bore of spindle 4, through apertures 41 and into chamber 42 from where the water can pass into the bore 43 of nozzle 9. The bore 43 of nozzle 9 has an upwardly directed outlet portion 43*a*. Water is discharged from nozzle 9 at a constant pressure irrespective of the tilted position of nozzle 9 and falls in radially extending curtain which moves about sprinkler $A_5$.

By suitably relating the ratio between gear teeth 12 and gear teeth 13 and the angle $\alpha$ at which the upper spindle portion 4*b* is disposed relative to the vertical rotational axis X—X, a substantially circular area, a substantially square area, a substantially triangular area, or any other suitably shaped area may be irrigated.

If there is a small difference in the number of teeth 12 and the number of teeth 13, a substantially circular area may be irrigated.

By providing a ratio of 1.25:1 between teeth 12 and teeth 13 (such as for example 125 teeth 12 and 100 teeth 13) and by providing an angle $\alpha$ of about 10° between the longitudinal axis of upper spindle portion 4*b* and the vertical rotational axis X—X, a substantially square area may be irrigated.

By providing a ratio of $11\frac{1}{3}$:1 between the teeth 12 and the teeth 13 (such as for example 120 teeth 12 and 90 teeth 13) and by providing an angle $\alpha$ of about 15° between the longitudinal axis of upper spindle part 4*b* and the vertical rotational axis X—X, a substantially triangular area may be irrigated. The fluid drive means for spindle 4 comprises a cap 16*b* which is screwed onto the upper end of upper spindle portion 4*b* and has a blind bore with a transversely and upwardly directed discharge aperture 18*a*. Water can issue from discharge aperture 18*a* in a fine spray which falls to the ground in the immediate circular proximity of sprinkler $A_5$. The reaction of water issuing from discharge aperture 18*a* causes rotation of spindle 4. The means for protecting teeth 12 and 13 from dirt comprises annular member 44 on head 8 which presents a part spherical convex formation and an annular member 45 on body 1 which presents a complementary concave formation. The annular members 44, extend round teeth 12, 13 to provide an enclosure round teeth 12, 13 and are capable of a ball-and-socket type of universal movement.

Figure 18:
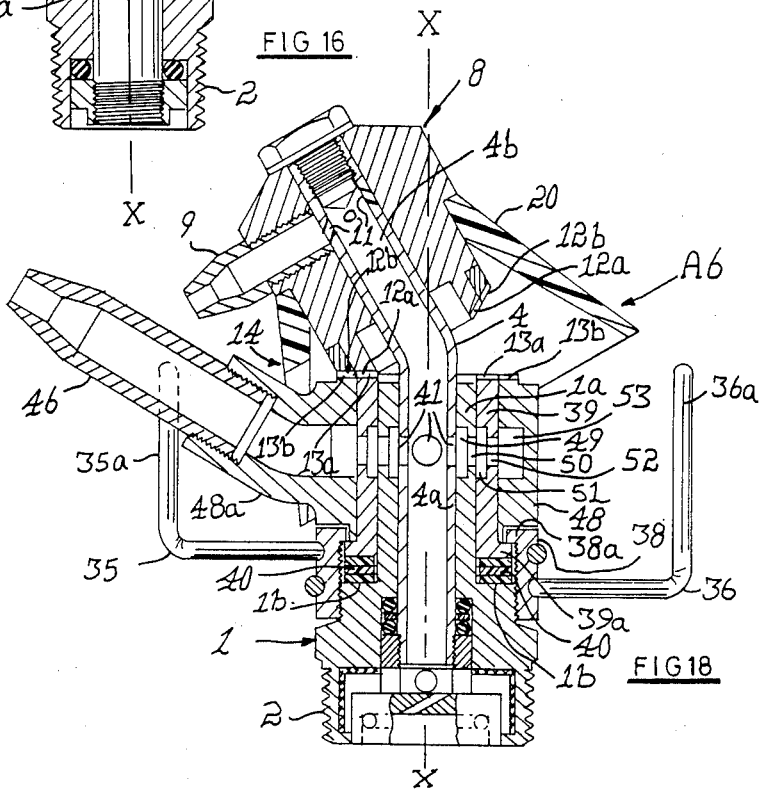
FIG. 18 is an elevational view in section of a further embodiment of an irrigation sprinkler according to the invention.

Referring now to FIG. 18, the tubular spindle 4 of sprinkler $A_6$ is adapted to be rotatably driven at the lower end of the lower spindle portion 4*a* by fluid drive means similar to that of FIGS. 11 and 12.

Head 8 is rotatably mounted on the upper slanted portion 4*b* of spindle 4 and carries a discharge nozzle 9. The supply of water from the bore of upper spindle portion 4*b* to the bore of nozzle 9 is via a series of apertures 11 through the wall of spindle 4 in a manner similar to that described above with reference to FIGS. 6 to 8.

A sleeve 39 is rotatably mounted on the upper vertical portion 1*a* of body 1 and has an outwardly directed bottom flange 39*a* adapted to engage annular friction pads 40 located on shoulder 1*b* of body 1. A screw threaded sleeve 38 with an inwardly directed flange 38*a* is in screw threaded engagement with body 1 below shoulder 1*b*. Flange 38*a* of threaded sleeve 38 is adapted to engage flange 39*a* of sleeve 39. A tubular housing 48 is rotatably mounted on sleeve 39 and presents a transverse tubular formation 48*a* in which an upwardly tilted nozzle 46 is mounted.

Circumferentially spaced apertures 41 extend through the wall of lower spindle portion 4*a* and is in communication with a surrounding annular chamber 49 defined in upper body part 1*a*. Circumferentially spaced apertures 50 through body part 1*a* places chamber 49 in communication with surrounding annular chamber 51 defined in sleeve 39. Circumferentially spaced apertures 52 in sleeve 39 places chamber 51 in communication with surrounding annular chamber in tubular housing 48. The bores of transverse tubular formation 48*a* and nozzle 46 communicate with chamber 53. Water under pressure can flow from the bore of tubular spindle 4 to discharge nozzle 46 via apertures 41, chamber 49, apertures 50, chamber 51, apertures 52, chamber 53 and the bore of transverse tubular formation 48*a*.

Housing 48 and discharge nozzle 46 can rotate about vertical rotational axis X—X but cannot oscillate longitudinally therealong. Head 8 and nozzle 9 can rotate about vertical axis X—X and also tilt longitudinally therealong.

In order to rotate nozzles 9 and 46 in unison with each other about vertical axis X—X, an inner ring of teeth 12*a* and an outer ring of teeth 12*b* are fast with the lower end of head 8. An inner ring of teeth 13*a* engageable by inner teeth 12*a* of head 8, is fast with the upper end of sleeve 39. An outer ring of teeth 13*b* engageable by outer teeth 12*b* of head 8, is fast with the housing 48.

The number of outer teeth 12*b* on head 8 is equal to the number of outer teeth 13*b* on housing 48. As head 8 is rotated about vertical axis X—X under the influence of operative rotation of spindle 4 about axis X—X, teeth 12*b* and 13*b* cause housing 48 and nozzle 46 to be rotated in unison with and at the same speed and in the same direction as head 8 and nozzle 9.

Head 8 and its nozzle 9 as well as the housing 48 and its nozzle 46 may be adapted to have a reciprocatory rotational movement between limits defined by stop members 35*a* and 36*a* in the same manner as that described above with reference to FIG. 15, by providing a set of inner teeth 12*a* on head 8 which is smaller in number than the set of inner teeth 13*a* on housing 48 and by providing circumferentially spaced stop members 35*a* and 36*a* which are fast with threaded screw 38. Stop members 35*a*, 36*a* are engageable by nozzle 46 so that threaded sleeve 38 is rotatable in opposite directions alternately to lock and release each of inner and outer rings of teeth 13*a*, 13*b* to and from body 1, the one ring of teeth being locked when tbe other ring is released and the locked and released conditions of the two rings of teeth 13*a*, 13*b* being reversed each time nozzle 9 reaches the one and the other of the two stop formations 35*a*, 36*a*.

Figure 19:
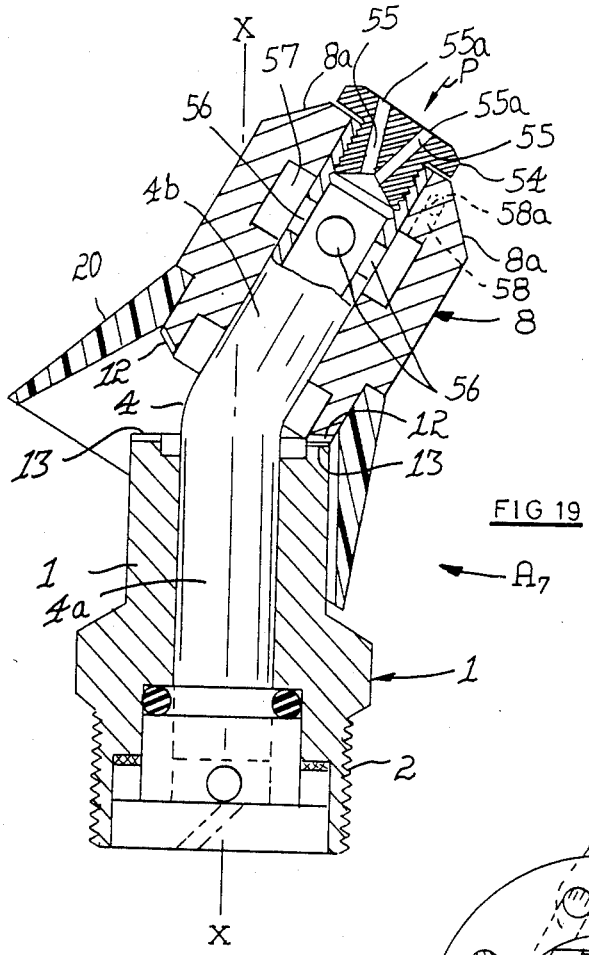
FIG. 19 is an elevational view in section of a further embodiment of an irrigation sprinkler according to the invention.
Figure 20:
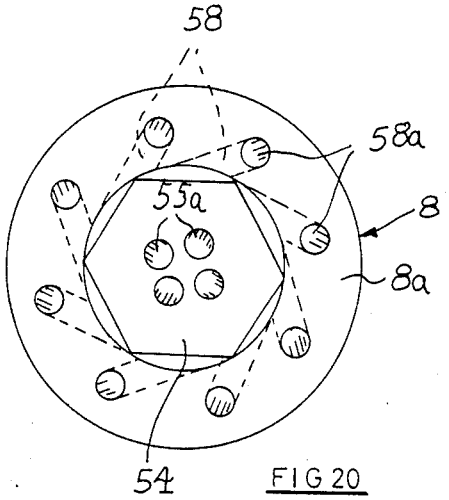
FIG. 20 is an end view in the direction of arrow P in FIG. 19 of the head of the sprinkler, illustrating the discharge passages and outlets.
Figure 21:
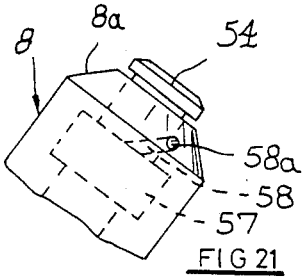
FIG. 21 is a fragmentary elevational view of the upper end of the head of the sprinkler of FIG. 19, illustrating a discharge passage and outlet.

In all the embodiments described above with reference to FIGS. 1 to 18, the heads 8 and the nozzles 9 thereon not only oscillate up and down longitudinally along the vertical rotational axis X—X of spindle 4 during operative rotation of spindle 4, but also rotate about axis X—X. In the embodiment of FIGS. 19, 20 and 21, the head 8 of sprinkler $A_7$ does not rotate about the vertical rotational axis X—X but only oscillates up an down longitudinally relative to axis X—X to irrigate an elongate rectangular area.

The tubular spindle 4 of sprinkler $A_7$ is rotatably driven at the lower end of the lower spindle portion by any suitable fluid drive means. A set of gear teeth 12 is fast with the lower end of head 8 and is disposed in annular formation about spindle 4 and is adapted to engage with a set of gear teeth 13 which is fast with the upper end of body 1 and is disposed in annular formation about spindle 4. The teeth 12 are equal in number to the teeth 13.

As the teeth 12 are equal in number to the teeth 13, head 8 does not rotate about rotational axis X—X as spindle 4 is operatively rotated about axis X—X. Head 8 remains in the same circumferential position relative to body 1 but oscillates up and down longitudinally relative to axis X—X during operative rotation of spindle 4.

It will be seen that a plug 54 with outwardly radiating discharge passages 55 therethrough, is screwed into the upper end of the upper spindle portion 4*b*. Water under pressure can discharge from the bore of spindle 4 through passages 55 and their discharge ports 55*a*.

Radially spaced passages 56 extends through the wall of upper spindle portion 4*b* and place the bore of spindle 4 in communication with annular chamber 57 in head 8 which extends round spindle 4. Sloping passages 58 extend upwardly from chamber 57 and have discharge ports 58*a* in the sloping upper end 8*a* of head 8. Water under pressure can also discharge from the bore of spindle 4 through passages 58 and their discharge ports 58*a*.

It will be appreciated that many variations in detail other than those described above are possible, without departing from the scope of the appended claims. For example any suitable fluid drive means other than that described above with reference to FIGS. 1 to 13 of the drawings, may be used for rotatably driving tubular spindle 4. A suitable turbine with blades fast with spindle 4 may be used.

It is also possible operatively to drive a sprinkler according to tbe invention by rotatably driving the head 8 relative to tbe slanted upper portion 4*b* of tubular spindle 4 under the action of fluid under pressure flowing through the sprinkler. Fluid drive means similar to that described above with reference to FIGS. 11 to 13 of the drawings, may provided in the head 8, such drive means may comprise annular reaction member of mesh material which is fast with head 8 and is located in an annular chamber in the head 8 which extends round the spindle 4; and a suitably sloping passage for discharging water under pressure from the bore of the upper spindle portion 4*b* into the annular chamber so that water impinges at a suitable angle on the reaction element.

I claim:

1. Sprinkler means including a body; a tubular spindle mounted on the body and adapted to be rotatable about a rotational axis relative to the body, the tubular spindle having a fluid inlet in the region of the body and including a slanted portion projecting from the body at an angle to the rotation axis of the tubular spindle; a head rotatably mounted on the slanted portion of the tubular spindle for rotation relative to the slanted portion about the longitudinal axis of the latter; fluid discharge means from the head in communication with the interior of the tubular spindle; at least one set of gear teeth disposed in annular formation on the body about the tubular spindle; and at least one set of gear teeth disposed in annular formation on the head about the tubular spindle, the head being tilted relative to the rotational axis of the tubular spindle such that gear teeth on the head are engageable with gear teeth on the body, the slanted portion of the tubular spindle and the engagement between the gear teeth on the head and the body being arranged such that upon rotation of the tubular spindle relative to the body or upon rotation of the head relative to the tubular spindle, the head and the discharge means are caused at least to oscillate in a longitudinal direction with respect to the rotational axis of the tubular spindle.

2. A sprinkler means as claimed in claim 1, wherein the slanted portion of the tubular spindle and the engagement of the gear teeth on the head and the body are arranged such that upon rotation of the tubular spindle relative to the body or upon rotation of the head relative to the tubular spindle, the head and the discharge means are caused to rotate relative to the body about the rotational axis of the tubular spindle and also to oscillate in a longitudinal direction with respect to the rotational axis of the tubular spindle during rotation about the rotational axis.

3. Sprinkler means as claimed in claim 2, wherein there is a difference in the number of teeth in the set of gear teeth on the head and the number of teeth in the set of gear teeth on the body.

4. Sprinkler means as claimed in claim 3, wherein there is a small difference in the number of teeth on the head and the number of teeth on the body.

5. Sprinkler means as claimed in claim 3, wherein the ratio between the number of teeth on the head and the body is 1.25:1 and the angle between the longitudinal axis of the slanted upper portion of the tubular spindle and the rotational axis of the spindle is about 10°.

6. Sprinkler means as claimed in claim 3, wherein the ratio between the number of teeth on the head and tbe body is 1.33:1 and the angle between the longitudinal axis of the slanted upper portion of the tubular spindle and the rotational axis of the spindle is about 15°.

7. Sprinkler means as claimed in claim 2, wherein said gear teeth on said head comprise a first set of gear teeth and second set of gear teeth which are disposed concentrically one within the other in annular formation about the spindle and are fast with the head, and are interengageable with said gear teeth disposed on said body which comprise a first set of gear teeth and a second set of gear teeth respectively and which are disposed concentrically one within the other in annular formation about the spindle and are rotatably mounted on the body, the number of teeth in the first set on the head being smaller than the number of teeth in the first set on the body and the number of teeth in the second set on the head being larger than the number of teeth in the second set on the body, each of the first and second sets of gear teeth on the body being adapted to be alternately locked to the body and to be released for rotation relative to the body, the one set of gear teeth on the body being locked when the other set is released and the locked and released conditions of the two sets of gear teeth on the body being reversed each time the head reaches the one and the other of two circumferentially spaced positions during rotational movement of the head about the vertical axis.

8. Sprinkler means as claimed in claim 7, wherein each of the first and second sets of teeth on the body is fast with a respective annular member which is rotatably mounted on the body; and a locking member is in screw-threaded engagement with the body, rotation of the locking member in one direction relative to the body causing the one annular member to be locked to the body and the other annular member to be released for rotation relative to the body and rotation of the locking member in the other direction relative to the body causing the one annular member to be released for rotation relative to the body and the other annular member to be locked to the body; and means is provided to cause rotation of the locking member in the required direction to reverse the locked and released conditions of the two annular members each time the head reaches the one and the other of the two circumferentially spaced positions during rotational movement of the head about the vertical axis.

9. Sprinkler means as claimed in claim 2, wherein the set of gear teeth on the body is rotatably mounted on the body and capable of restrained rotation relative to the body.

10. Sprinkler means as claimed in claim 9, wherein the set of gear teeth on the body is fast with an annular member which is rotatably mounted on the body; and a locking member is in screw threaded engagement with the body, rotation of the locking member in the one direction causing the annular member to be locked to the body and rotation of the locking member in the opposite direction causing the annular member to be released at least partially to permit restrained rotation of the annular member and the gear teeth thereon relative to the body.

11. Sprinkler means as claimed in claim 9 or 10 wherein the number of gear teeth on the head is less than the number of gear teeth on the body, the set of gear teeth on the body being adapted to be alternately locked to the body and to be released for restrained rotational movement relative to the body, the locked and released conditions of the set of gear teeth on the body being reversed each time the head reaches the one and the other of two circumferentially spaced positions during rotational movement of the head about the vertical axis.

12. Sprinkler means as claimed in claim 1, wherein the number of teeth in the set of gear teeth on the head is equal to the number of gear teeth in the set of teeth on the body, whereby the head and the discharge means are adapted to oscillate in a longitudinal direction with respect to the rotational axis of the tubular spindle.

13. Sprinkler means as claimed in claim 1 or claim 2 including control means between the body and the tubular spindle which is adapted to exert frictional restraint on the rotation of the spindle relative to the body.

14. Sprinkler means as claimed in claim 13, wherein the control means comprises a resiliently compressible friction element of annular configuration which is interposed between co-operating annular formations on the body and the spindle which are disposed transversely to the rotational axis of the spindle.

15. Sprinkler means as claimed in claim 1 or claim 2 including fluid drive means for producing operative movement of the sprinkler means.

16. Sprinkler means as claimed in claim 1 or claim 2, wherein the slanted portion of the tubular spindle protrudes from the head; and a rearwardly facing aperture is provided through the wall of the protruding part of the slanted portion of the tubular spindle, the reaction of fluid under pressure issuing from the aperture causing rotation of the tubular spindle relative to the body.

17. Sprinkler means, comprising:

a body;

a tubular spindle mounted on the body and being rotatable about a rotational axis relative to the body, the tubular spindle having a fluid inlet in the region of the body and including a slanted portion projecting from the body at an angle to the rotational axis of the tubuar spindle;

an annular head which is rotatably mounted on the slanted portion of the tubular spindle and is in engagement with the body, the head embracing the slanted portion and being rotatable relative to the slanted portion about the longitudinal axis of the latter; and fluid discharge means from the head in communication with the interior of the tubular spindle for discharging fluid from the interior of the tubular spindle, the slanted portion of the tubular spindle and the engagement of the head with the body being arranged such that upon rotation of the tubular spindle relative to the body or upon rotation of the head relative to the tubular spindle, the head and the discharge means are caused at least to oscillate in a longitudinal direction with respect to the rotational axis of the tubular spindle.

18. Sprinkler means, including:

a body;

a tubular spindle mounted on the body and being rotatable about a rotational axis relative to the body, the tubular spindle having a fluid inlet in the region of the body and including a slanted portion projecting from the body at an angle to the rotational axis of the tubular spindle;

an annular head which is rotatably mounted on the slanted portion of the tubular spindle and is in engagement with the body, the head embracing the slanted portion and being rotatable relative to the slanted portion about the longitudinal axis of the latter;

and fluid discharge means from the head in communication with the interior of the tubular spindle for discharging fluid from the interior of the tubular spindle, the slanted portion of the tubular spindle and the engagement of the head with the body being arranged such that upon rotation of the tubular spindle relative to the body or upon rotation of the head relative to the tubular spindle, the head and the discharge means are caused to oscillate in a longitudinal direction with respect to the rotational axis of the tubular spindle and also to rotate relative to the body about the rotational axis of the tubular spindle.

* * * * *

UNITED STATES PATENT AND TRADEMARK OFFICE

CERTIFICATE OF CORRECTION

PATENT NO. : 4,671,462

DATED : June 9, 1987

INVENTOR(S) : BADRIA

Figure 16:
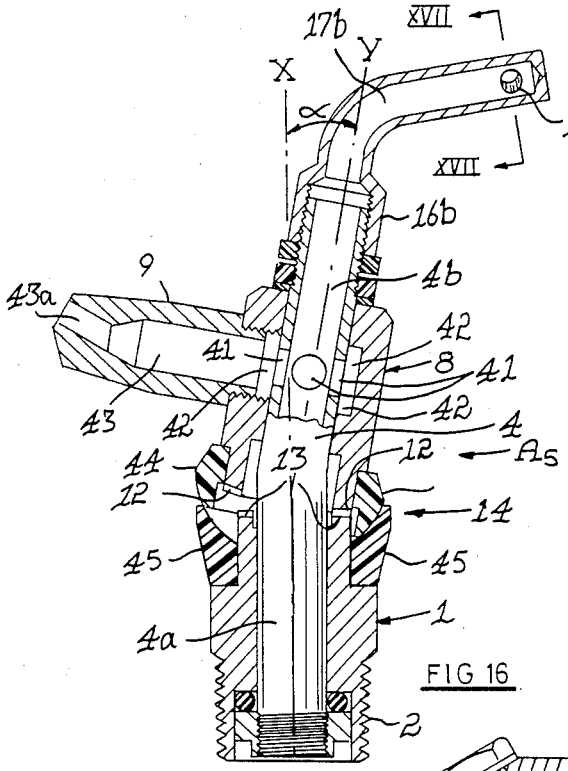
Figure 17:
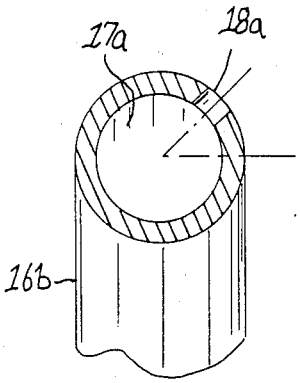
FIG. 17 is a section on the line XVII—XVII in FIG. 16, illustrating the fluid drive outlet.

It is certified that error appears in the above-identified patent and that said Letters Patent is hereby corrected as shown below:

Column 1 line 34 delete "annular" and replace by --tubular--
Column 1 line 60 delete "bead" and replace by --head--
Column 2 line 9 delete "that" and replace by --than--
Column 2 line 13 delete "discbarge" and replace by --discharge--
Column 2 line 20 delete "rat io" and replace by --ratio--
line 23 delete "tbrough" and replace by --through--
line 37 delete "tbrough" and replace by --through--
Column 4 line 4 delete "Fig. 18" and replace by --Fig. 16--
Column 4 line 53 delete "head B" and replace by --head 8--
Column 4 line 60 insert --9-- after "nozzles"
Column 5 line 29 delete "head" and replace by --cap--
line 32 delete "teetb 18" and replace by --teeth 13--
line 45 delete "discbarge" and replace by --discharge--
line 57 delete "annular" and replace by --tubular--
Column 6 line 13 insert --16-- after "cap"
line 18 delete "lowes" and replace by --lowest--
line 35 delete "tbe" and replace by --the--
Column 8 line 14 insert --5-- after "and"
line 44 delete "27" and replace by --25--
line 56 delete "8" and replace by --3-- cont'd...

UNITED STATES PATENT AND TRADEMARK OFFICE

CERTIFICATE OF CORRECTION

PATENT NO. : 4,671,462

DATED : June 9, 1987

INVENTOR(S) : BADRIA

It is certified that error appears in the above-identified patent and that said Letters Patent is hereby corrected as shown below:

Column 8 line 61 delete "tbe" and replace by --the--
Column 9 line 30 delete "38" and replace by --33--
line 44 delete "32a" and replace by --33a--
Column 10 line 13 insert --9-- after "nozzle"
line 43 delete "ring" and replace by --sleeve--
line 67 delete "body 1" and replace by --sleeve 39--
Column 11 line 16 delete "an"
line 43 delete "1" and replace by --8--
Column 12 line 1 delete "11 1/3:1" and replace by --1 1/3:1--
line 19 insert --45-- after "44,"
line 52 insert --53-- after "chamber"
Column 13 line 16 delete "housing 48" and replace by --sleeve 39--
line 18 delete "threaded screw" and replace by --screw threaded sleeve 38.--
line 37 delete "an" and replace by --and--
Column 14 line 10 delete "tbe" and replace by --the--
line 11 delete "tbe" and replace by --the--
line 15 insert --be-- after "may"
line 29 delete "rotation" and replace by --rotational--

UNITED STATES PATENT AND TRADEMARK OFFICE

CERTIFICATE OF CORRECTION

PATENT NO. : 4,671,462

DATED : June 9, 1987

INVENTOR(S) : BADRIA

It is certified that error appears in the above-identified patent and that said Letters Patent is hereby corrected as shown below:

Column 15 line 5 delete "tbe" and replace by --the--

Signed and Sealed this

Twenty-sixth Day of April, 1988

*Attest:*

*Attesting Officer*

DONALD J. QUIGG

*Commissioner of Patents and Trademarks*